US010638556B1

(12) United States Patent
Allen et al.

(10) Patent No.: US 10,638,556 B1
(45) Date of Patent: Apr. 28, 2020

(54) MICROWAVABLE STACKING TRAY

(71) Applicants: Jeffery Lance Allen, Harbor City, CA (US); Sandra G. Allen, San Pedro, CA (US)

(72) Inventors: Jeffery Lance Allen, Harbor City, CA (US); Sandra G. Allen, San Pedro, CA (US)

(73) Assignee: Jeffery Lance Allen, San Pedro, CA (US)

( * ) Notice: Subject to any disclaimer, the term of this patent is extended or adjusted under 35 U.S.C. 154(b) by 421 days.

(21) Appl. No.: 15/146,782

(22) Filed: May 4, 2016

Related U.S. Application Data

(60) Provisional application No. 62/128,431, filed on Mar. 4, 2015.

(51) Int. Cl.
*H05B 6/64* (2006.01)

(52) U.S. Cl.
CPC ..... *H05B 6/6408* (2013.01)

(58) Field of Classification Search
CPC ..... H05B 6/6408; H05B 6/6479; H05B 6/64; B65D 81/3446; B65D 81/3453; B65D 81/3825; B65D 2205/02; B65D 81/34; F24C 7/02; A47B 7/02; A47B 9/20
USPC ..... 219/732, 679, 678, 725, 735, 754, 757, 219/762, 763, 739, 756, 759, 730, 733; 108/91, 92, 147.19, 24, 25
See application file for complete search history.

(56) References Cited

U.S. PATENT DOCUMENTS

| | | | | |
|---|---|---|---|---|
| 2,502,667 | A * | 4/1950 | Pagett | F16M 11/10 248/161 |
| 2,837,388 | A * | 6/1958 | Majeroni | A47G 23/0608 108/25 |
| 3,987,267 | A * | 10/1976 | Moore | A23L 3/01 219/728 |
| 4,249,464 | A * | 2/1981 | Hansen | H05B 6/6408 108/156 |
| 4,398,880 | A * | 8/1983 | Seiling | A21C 13/02 198/803.14 |
| 4,704,872 | A * | 11/1987 | Jones | F25B 21/02 62/3.2 |
| 4,847,461 | A * | 7/1989 | Gilmore | A47G 19/08 219/732 |
| 5,565,228 | A * | 10/1996 | Gics | B65D 81/3453 206/564 |
| 6,273,284 | B1 * | 8/2001 | Nottage | H05B 6/6408 211/195 |
| 7,667,168 | B2 * | 2/2010 | Smith | H05B 6/6408 126/338 |
| 2004/0069149 | A1 * | 4/2004 | Wakefield | A47J 27/16 99/330 |
| 2007/0045303 | A1 * | 3/2007 | Smith | H05B 6/6408 219/732 |

(Continued)

*Primary Examiner* — Tu B Hoang
*Assistant Examiner* — Masahiko Muranami
(74) *Attorney, Agent, or Firm* — Plager Schack LLP

(57) ABSTRACT

A microwave safe tray may be configured to provide a user with multiple surfaces on which to heat items. The tray may include a rectangular support surface including a plurality of flow orifices, the rectangular support surface configured to support items to be heated; and a plurality of legs extending substantially perpendicularly from the rectangular support tray. The microwave-safe tray may be configured to support a second microwave-safe tray in a stacked configuration.

3 Claims, 4 Drawing Sheets

(56) References Cited

U.S. PATENT DOCUMENTS

2011/0250325 A1* 10/2011 Lion ..... A47J 36/027
426/242
2013/0118473 A1* 5/2013 Linton ..... A47J 37/0694
126/337 R

* cited by examiner

MICROWAVABLE STACKING TRAY

RELATED APPLICATION

This application claims priority to provisional patent application U.S. Ser. No. 62/128,431 filed on Mar. 4, 2015, the entire contents of which is herein incorporated by reference.

BACKGROUND

The embodiments herein relate generally to kitchen utensils, and more particularly, to a microwavable stacking tray.

Microwaves have a single layer heating capacity or a turntable, which usually limits the heating ability to one item or plate. Thus, if a microwave is being used to reheat a meal for a group of people, each person's plate has to be heated individually, which results in the plates not being heated up together. As a result, the group cannot eat warm food together at the same time. Rather, the first person's heated plate tends to cool down by the time the last person's plate has been heated.

Conventional stackable microwave trays that exist are round, which limits the surface area that a plate or food item can be placed. However, the microwave itself generally has a significantly larger interior and could accommodate a larger tray.

Therefore, what is needed is microwavable stacking tray with a surface area larger than a conventional microwavable stacking tray, wherein the microwavable stacking tray allows a user to heat multiple plates of food simultaneously.

SUMMARY

Some embodiments of the present disclosure include a microwave safe tray configured to provide a user with multiple surfaces on which to heat items. The tray may include a rectangular support surface including a plurality of flow orifices, the rectangular support surface configured to support items to be heated; and a plurality of legs extending substantially perpendicularly from the rectangular support tray. The microwave-safe tray may be configured to support a second microwave-safe tray in a stacked configuration.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to heat multiple layers of items at one in, for example, a microwave, and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Support Surface
2. Legs
3. Flow Orifices

The various elements of the device of the present disclosure may be related in the following exemplary fashion. It is not intended to limit the scope or nature of the relationships between the various elements and the following examples are presented as illustrative examples only.

Figure 7:
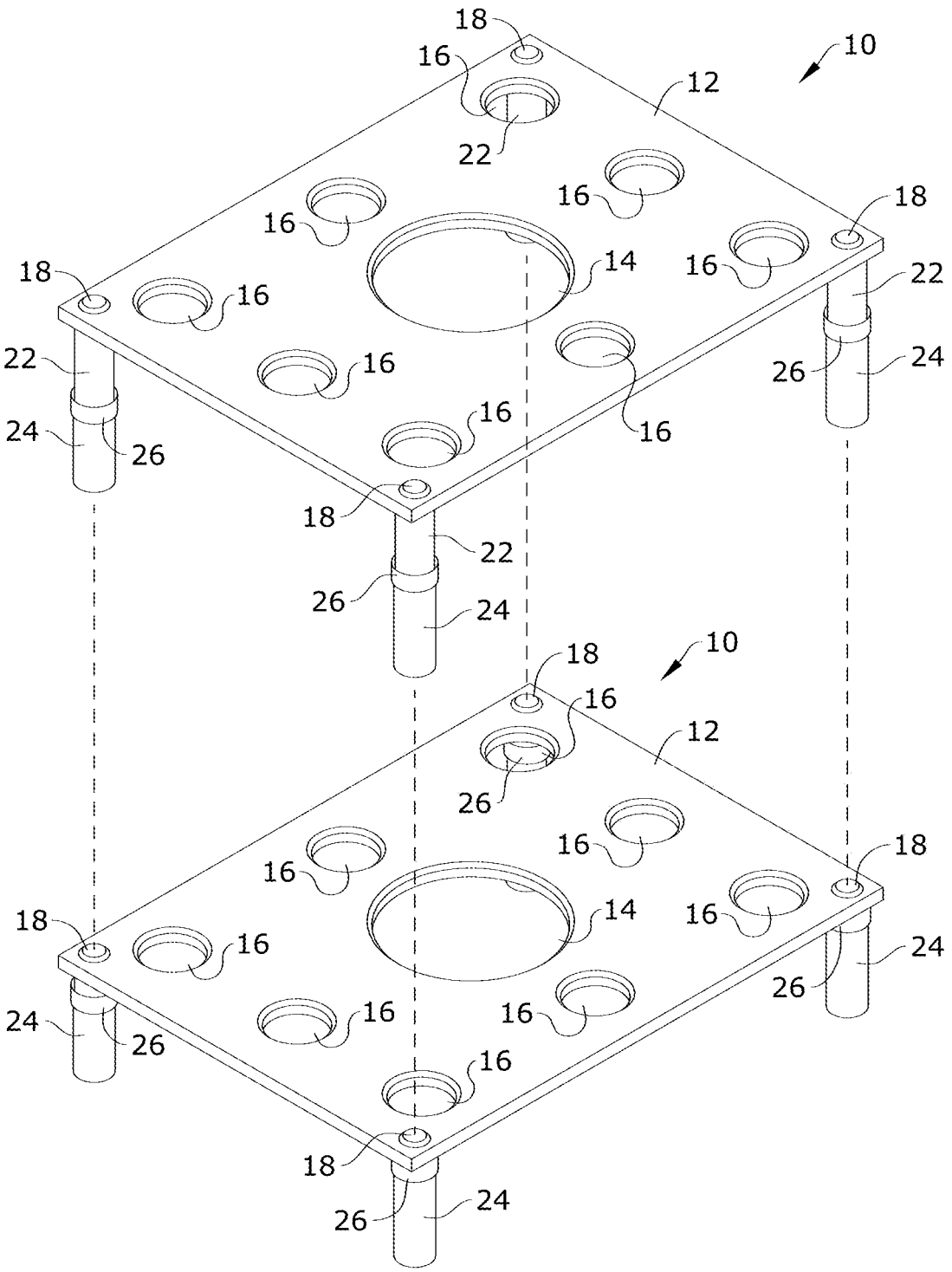
FIG. 7 is a perspective view of an embodiment of the present disclosure.

By way of example, and referring to FIGS. 1-7, some embodiments of the present disclosure include a microwavable stacking tray 10 for heating multiple layers of items, such as food products 32, in, for example, a microwave oven 28, the microwavable stacking tray 10 comprising a support surface 12 configured to support an item to be heated, wherein the support surface 12 comprises a plurality of flow orifices 14, 16, and a plurality of legs 20 extending substantially perpendicularly downward from the support surface 12, wherein the legs 20 are configured to hold the support surface 12 substantially parallel to a surface on which the tray 10 is placed. In embodiments, as shown in FIG. 7, the tray 10 may be stackable, such that multiple trays 10 may be safely stacked on top of one another, creating multiple levels of surfaces on which items may be heated.

As shown in the Figures, the support surface 12 may be substantially rectangular and may have four legs 20 extending downward therefrom, wherein each leg 20 is positioned proximate to a corner of the support surface 12. Thus, the legs 20 may be positioned so as to not interfere with the use of a turntable 30, rotating plate, or other tray that comes with some conventional microwave ovens 28. The tray 10 may have a size suitable for holding a plate or platter configured to accommodate a family-sized meal. In some embodiments, such as those shown in FIGS. 5 and 6, the legs may comprise an upper leg portion 22 configured to telescope out of a lower leg portion 24 such that the length of the legs and, thus, the height of the tray 10 is adjustable. In embodiments with adjustable legs, the tray 10 may further comprise a leg lock ring 26 on each leg, wherein the leg lock ring 26 is configured to lock the upper leg portion 22 at its desired position. For example, the leg lock ring 26 may lock the upper leg portion 22 into position with respect to the lower leg portion 24*by* rotating the leg lock ring 26 clockwise.

As described above, the support surface 12 may comprise a plurality of flow orifices. For example and as shown in the Figures, the support surface 12 may comprise a large centrally located flow orifice 14 surrounded by a plurality of small flow orifices 16, such as about eight small flow orifices 16. As shown in the Figures, the flow orifices 14, 16 may be circular in shape. The flow orifices 14, 16 may allow for air to flow through the tray 10 during use.

Figure 1:
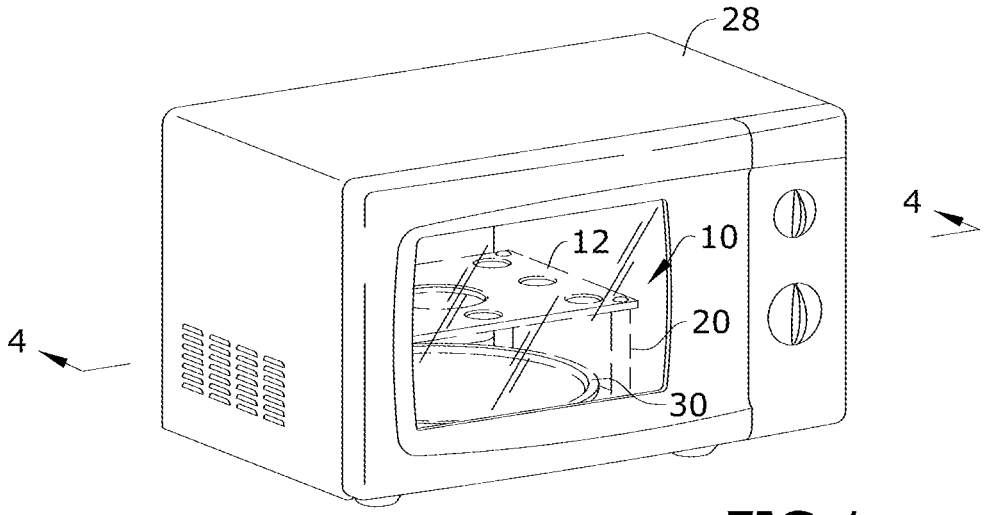
FIG. 1 is a perspective view of one embodiment of the present disclosure, shown in use.
Figure 2:
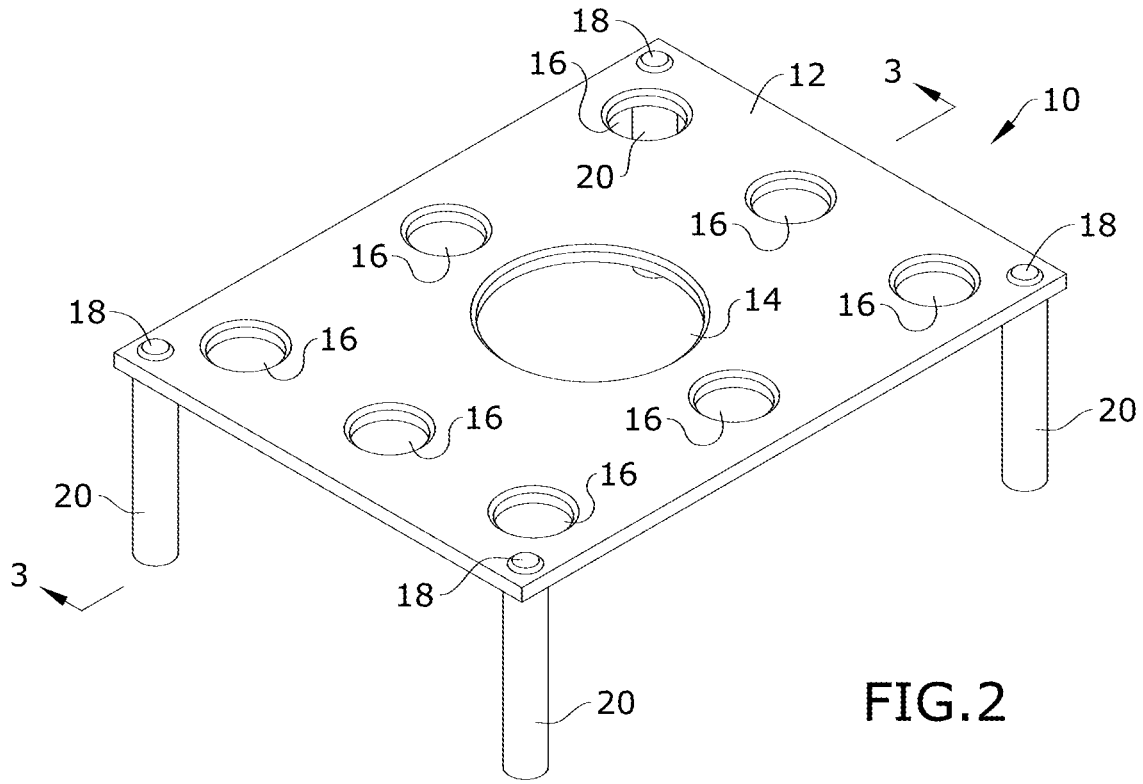
FIG. 2 is a perspective view of one embodiment of the present disclosure.
Figure 3:
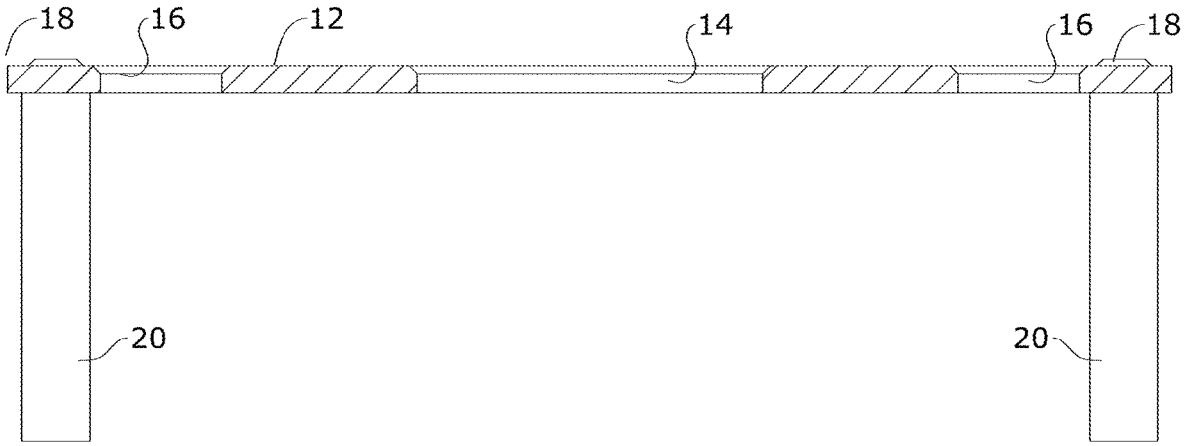
FIG. 3 is a section view of one embodiment of the present disclosure, taken along line 3-3 in FIG. 2.
Figure 4:
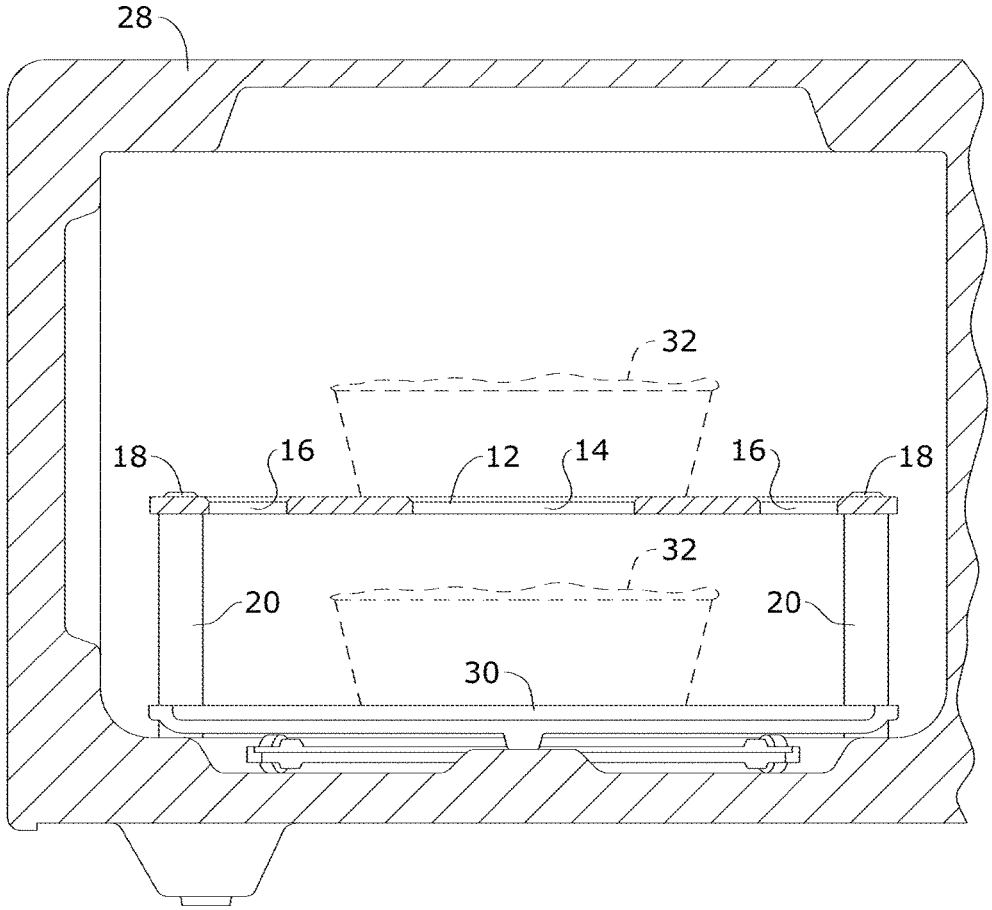
FIG. 4 is a section view of one embodiment of the present disclosure, taken along line 4-4 in FIG. 1.
Figure 5:
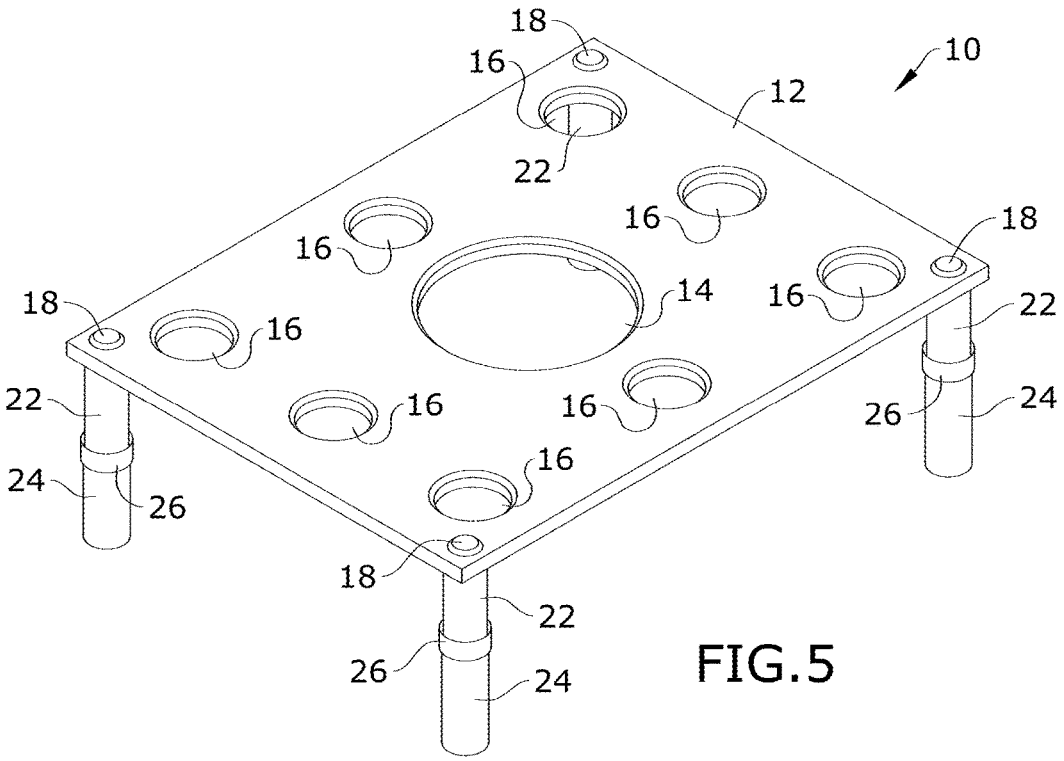
FIG. 5 is a perspective view of an embodiment of the present disclosure.
Figure 6:
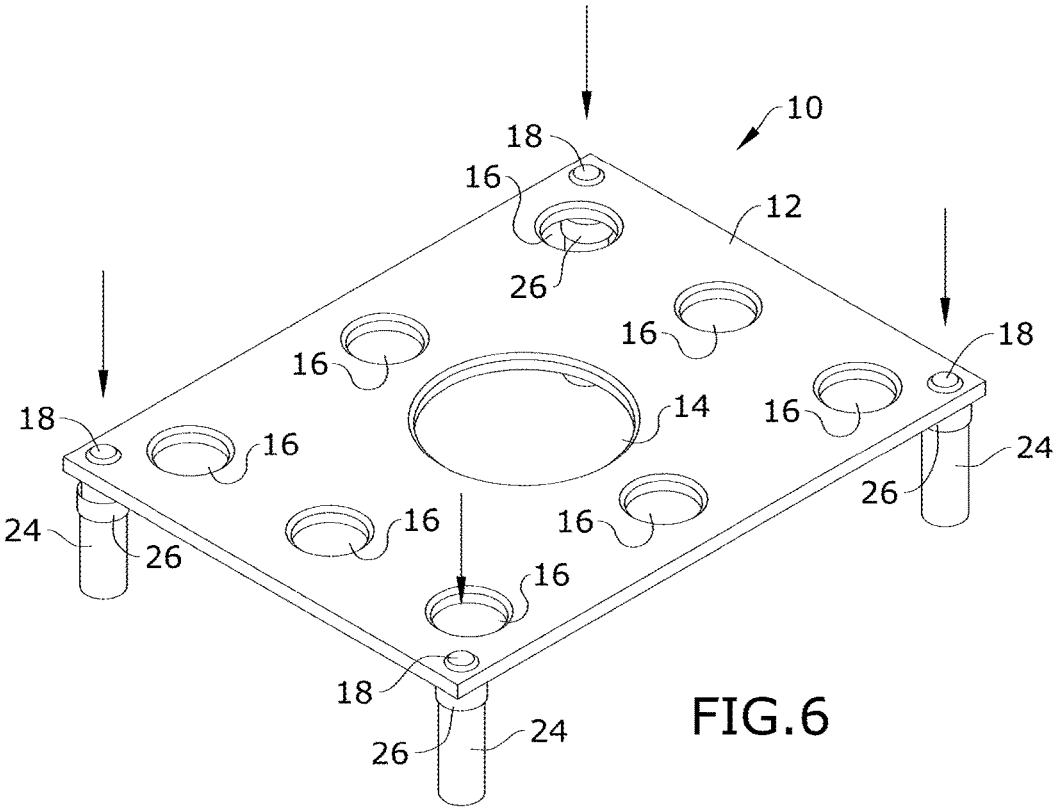
FIG. 6 is a perspective view of an embodiment of the present disclosure.

In some embodiments, the tray 10 may further comprise a plurality of bumpers 18 attached to a surface of the support surface 12 configured to have food placed thereon. For example, a bumper 18 may be attached proximate to each corner of the tray 10. The bumpers 18 may extend slightly upwardly from the support surface 12, as shown in FIGS. 3 and 4.

The tray 10 of the present disclosure may be made of any suitable material, such as a material that is safe to be heated or microwaved. For example, the tray 10 may comprise Lexon. Alternatively, the tray 10 may comprise any other microwavable material, such as ceramic or other microwave safe plastic.

To use the tray 10 of the present disclosure, a user may insert the legs 20 into the support surface 12, place the tray 10 into the microwave 28, and place food 32 thereon. The microwave 28 may then be used as normal. Although the tray 10 of the present disclosure is described to be used in a microwave, the tray 10 may also be used in a variety of different applications.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A microwave safe tray assembly, configured to provide a user with multiple surfaces on which to heat items, the tray assembly comprising:

a first tray further comprising:

a first rectangular support surface, further comprising:

a first rectangular support surface first edge joined to a first rectangular support surface second edge at a first rectangular support surface first corner;

a first rectangular support surface third edge joined to the first rectangular support surface second edge at a first rectangular support surface second corner;

a first rectangular support surface fourth edge joined to the first rectangular support surface third edge at a first rectangular support surface third corner; wherein the first rectangular support surface first edge is joined to the first rectangular support surface fourth edge at a first rectangular support surface fourth corner;

a first rectangular support surface first small flow orifice, arranged through the first rectangular support surface proximate the first rectangular support surface first corner;

a first rectangular support surface second small flow orifice, arranged through the first rectangular support surface proximate the first rectangular support surface second corner;

a first rectangular support surface third small flow orifice, arranged through the first rectangular support surface proximate the first rectangular support surface third corner;

a first rectangular support surface fourth small flow orifice, arranged through the first rectangular support surface proximate the first rectangular support surface fourth corner;

a first large centrally located flow orifice, arranged equidistant between the first rectangular support surface first small flow orifice, the first rectangular support surface second small flow orifice, the first rectangular support surface third small flow orifice, and the first rectangular support surface fourth small flow orifices;

a first rectangular length-adjustable leg, joined to a first rectangular support surface bottom side proximate the first rectangular support surface first corner;

a first rectangular length-adjustable leg, joined to first rectangular support surface bottom side proximate the first rectangular support surface second corner;

a first rectangular length-adjustable leg, joined to a first rectangular support surface bottom side proximate the first rectangular support surface third corner;

a first rectangular length-adjustable leg, joined to a first rectangular support surface bottom side proximate the first rectangular support surface fourth corner;

a first rectangular support surface first bumper, upward from a first rectangular support surface top side proximate the first rectangular support surface first corner;

a first rectangular support surface second bumper, upward from a first rectangular support surface top side proximate the first rectangular support surface second corner;

a first rectangular support surface third bumper, upward from a first rectangular support surface top side proximate the first rectangular support surface third corner;

a first rectangular support surface fourth bumper, upward from a first rectangular support surface top side proximate the first rectangular support surface fourth corner;

a second tray further comprising:

a second rectangular support surface, further comprising:

a second rectangular support surface first edge joined to a second rectangular support surface second edge at a second rectangular support surface first corner;

a second rectangular support surface third edge joined to the second rectangular support surface second edge at a second rectangular support surface second corner;

a second rectangular support surface fourth edge joined to the second rectangular support surface third edge at a second rectangular support surface third corner; wherein the second rectangular support surface first edge is joined to the second rectangular support surface fourth edge at a second rectangular support surface fourth corner;

a second rectangular support surface first small flow orifice, arranged through the second rectangular support surface proximate the second rectangular support surface first corner;

a second rectangular support surface second small flow orifice, arranged through the second rectangular support surface proximate the second rectangular support surface second corner;

a second rectangular support surface third small flow orifice, arranged through the second rectangular support surface proximate the second rectangular support surface third corner;

a second rectangular support surface fourth small flow orifice, arranged through the second rectangular support surface proximate the second rectangular support surface fourth corner;

a second large centrally located flow orifice, arranged equidistant between the second rectangular support surface first small flow orifice, the second rectangular support surface second small flow orifice, the second rectangular support surface third small flow orifice, and the second rectangular support surface fourth small flow orifices;

a second rectangular length-adjustable leg, joined to a second rectangular support surface bottom side proximate the second rectangular support surface first corner; and further engaged with the first rectangular support surface first bumper a second rectangular length-adjustable leg, joined to second rectangular support surface bottom side proximate the second rectangular support surface second corner; and further engaged with the first rectangular support surface second bumper a second rectangular length-adjustable leg, joined to a second rectangular support surface bottom side proximate the second rectangular support surface third corner; and further engaged with the first rectangular support surface third bumper a second rectangular length-adjustable leg, joined to a second rectangular support surface bottom side proximate the second rectangular support surface fourth corner; and further engaged with the first rectangular support surface fourth bumper a second rectangular support surface first bumper, upward from a second rectangular support surface top side proximate the second rectangular support surface first corner;

a second rectangular support surface second bumper, upward from a second rectangular support surface top side proximate the second rectangular support surface second corner;

a second rectangular support surface third bumper, upward from a second rectangular support surface top side proximate the second rectangular support surface third corner;

a second rectangular support surface fourth bumper, upward from a second rectangular support surface top side proximate the second rectangular support surface fourth corner;

wherein the first rectangular support surface supports the second rectangular support surface in a stacked configuration.

2. The microwave safe tray of claim 1, wherein the first rectangular support surface first leg further comprises a first rectangular support surface first leg upper leg portion configured to telescope out of a first rectangular support surface first leg lower leg portion.

3. The microwave-safe tray of claim 2, further comprising a first rectangular support surface first leg lock ring configured to lock the first rectangular support surface first leg upper leg portion at its desired position with respect to the first rectangular support surface first leg lower leg portion.

* * * * *